United States Patent [19]

Sanders, Jr.

[11] 4,390,233

[45] Jun. 28, 1983

[54] BATTERY CABLE CONNECTOR

[76] Inventor: David E. B. Sanders, Jr., 3743 Kayanne Ct., Tucker, Ga. 30084

[21] Appl. No.: 256,142

[22] Filed: Apr. 21, 1981

[51] Int. Cl.[3] ..... H01R 11/22; H01R 11/24

[52] U.S. Cl. ..... 339/255 R; 339/228; 339/108 TP

[58] Field of Search ..... 339/108 TP, 228, 254, 339/255 R, 255 B, 255 L

[56] References Cited

U.S. PATENT DOCUMENTS

| | | | |
|---|---|---|---|
| 1,254,172 | 1/1918 | Tefft | 339/228 |
| 2,085,853 | 7/1937 | Groves | 339/255 R |
| 2,168,250 | 8/1939 | Tolberg et al. | 339/228 |
| 2,659,876 | 11/1953 | Dupre et al. | 339/255 R |
| 2,831,174 | 4/1958 | Hilmo | 339/108 TP |
| 2,960,677 | 11/1960 | Stearn et al. | 339/254 R |
| 3,662,322 | 5/1972 | Morrison | 339/228 |
| 4,281,888 | 8/1981 | Seaman | 339/108 TP |

*Primary Examiner*—Joseph H. McGlynn
*Assistant Examiner*—Paula Austin
*Attorney, Agent, or Firm*—Shoemaker and Mattare, Ltd.

[57] ABSTRACT

A connector includes a jaw having an electrically conductive portion electrically and fixedly connected to an electrical cable and a non-conductive portion movably mounted on that cable. A spring connects the jaw portions together by urging the movable jaw portion toward the conductive jaw portion so an electrical terminal can be grasped by the jaw.

3 Claims, 5 Drawing Figures

BATTERY CABLE CONNECTOR

BACKGROUND OF THE INVENTION

The present invention relates in general to electrical connectors, and, more particularly, to booster cable connectors.

The inventor is aware of several cable connectors, such as, for example, those devices disclosed in U.S. Pat. Nos.: 1,254,172; 2,168,250; 2,714,196 and 3,662,322. However, all of these known devices are prone to tangling with either the cables being attached to a terminal, or with other devices. Thus, every time such known cable connectors are to be used, effort and time must be spent to untangle them and get them ready for use.

Furthermore, known cable connectors are expensive to manufacture, assemble and attach. Often, the known connectors require additional tools to effect the connection and still are not reliably held in place on the terminal.

SUMMARY OF THE INVENTION

The device embodying the teachings of the present invention includes a metallic jaw for electric contact. The material of this jaw is preferably non-corrosive material, such as ferrous or non-ferrous metals, but may be other materials, if suitable. The jaw has serrations that provide good contact for electrical transmission to the electrical terminal to which the device is attached while also having a good friction coefficient to retain the jaw in place. The jaw has a round shank which is long enough to extend into a stationary dielectric sleeve far enough to give the jaw rigidity. Preferably, the sleeve is formed of a dielectric material. A recess is defined in this round shank and preferably has a depth of approximately one inch.

The connector includes anti-fouling handles and electrical connection elements and is used with a single wire stranded cable having an insulating sheath. A necessary amount of sheath is removed from the cable at the end of the cable to permit electrical contact between the cable and one portion of the jaw. A set screw is used to make this electrical contact point permanent.

A cylindrical stationary sleeve is telescoped over this jaw and electrical conductor and is long enough to cover the shank portion of the jaw and several inches of the electrical conductor. In the case of battery booster cables, not longer than 7 inches nor shorter than 4 inches is to be covered. An expanding retainer nut is located on the end opposite the jaw and exerts pressure against the electrical cable when tightened into a threaded connection. Both the stationary sleeve and the retainer nut are dielectrics or non-conductors and preferably are formed of high impact plastic. An upset is integral with and located on the outer perimeter of the stationary sleeve and forms a spring stop.

A coiled non-corrosive spring is located around the stationary sleeve. This spring is long enough and has a spring constant selected so that sleeve displacement is sufficient to allow the jaw to open and spring strength is sufficient to maintain contact of the jaws against the battery terminal when pressure is released.

A movable sleeve has a length sufficient to cover the spring plus approximately one inch to allow retention of the spring as sliding movement takes place. A rolled lip is located at one end of the movable sleeve which contains or causes pressure to be applied to the spring in a lateral direction as pressure is applied laterally to the movable sleeve. A jaw integral with the sleeve is in facing opposition with the metal jaw and is formed of the same non-conductive material as the movable sleeve. An upset portion is positioned on the other end of the movable sleeve and is used to assist in retraction of the movable sleeve. A set screw is located in this sleeve end to limit travel of the movable sleeve when the cable connector is not in use.

Both the metal jaw and the dielectric jaw are maintained in the facing opposition with each other by a slot and ridge arrangement.

OBJECTS OF THE INVENTION

It is a main object of the present invention to provide an electrical connector which is not susceptible to tangling.

It is another object of the present invention to provide an electrical connector which is easily manufactured and used.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
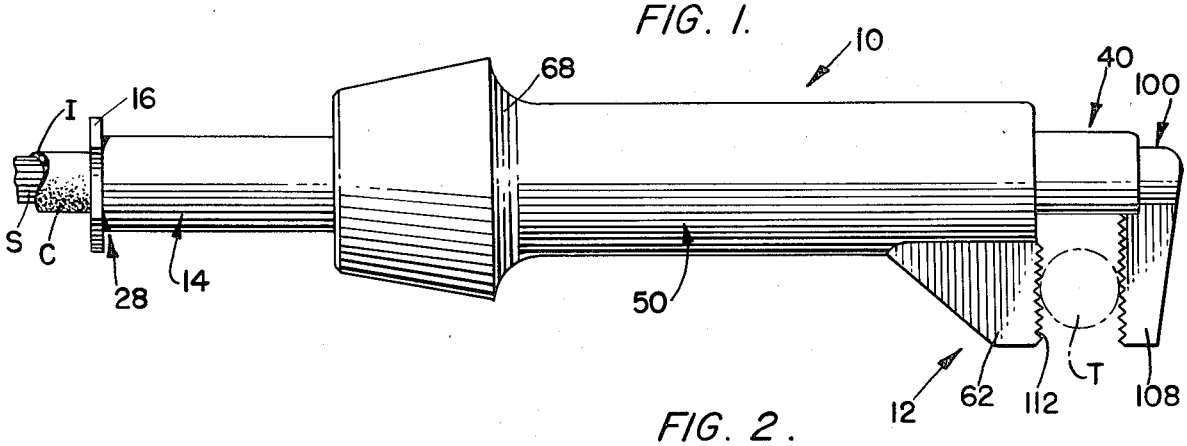
FIG. 1 is a side elevation of an electrical connector embodying the teachings of the present invention.
Figure 2:
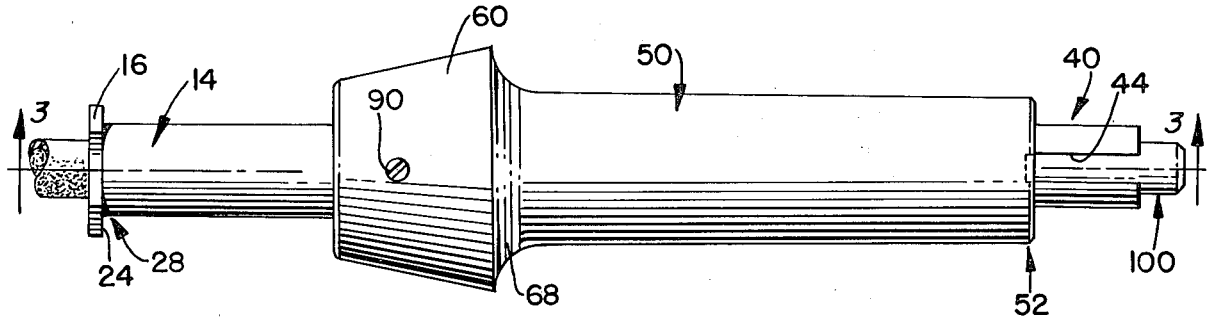
FIG. 2 is a top view of an electrical connector embodying the teachings of the present invention.

Shown in FIG. 1 is a connector 10 for an electrically connecting cable C, such as a booster cable, or the like, to a terminal T, such as a battery terminal, or the like. The connector 10 is infinitely adjustable within the range of movement and includes a gripping jaw 12 for gripping the terminal T to quickly and easily connect the cable C to that terminal T. In most cases, two connectors will be used. However, as both such connectors are identical, only one connector will be shown and described, with the understanding that such other connectors are identical to the one disclosed herein.

Figure 3:
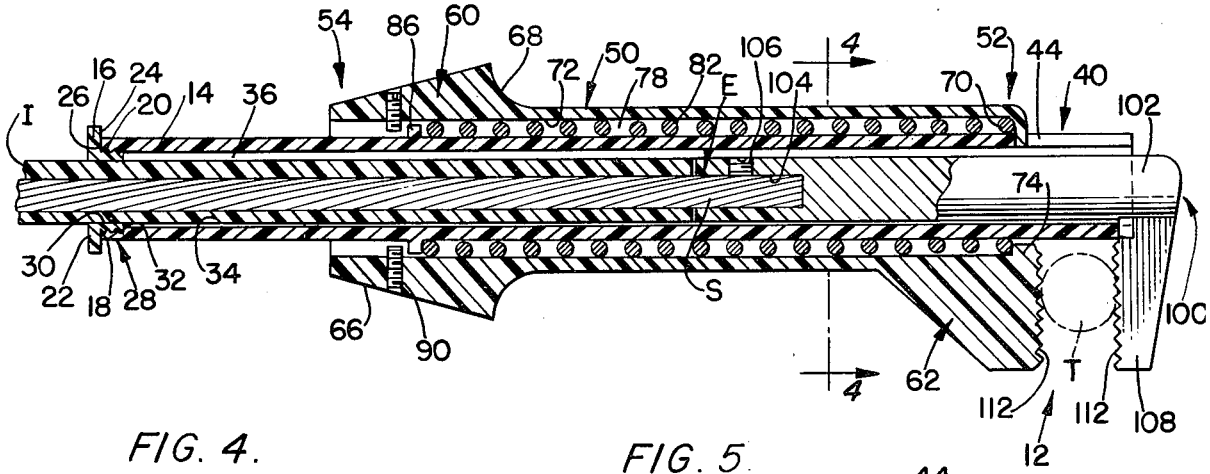
FIG. 3 is a view taken along line 3—3 of FIG. 2.
Figure 4:
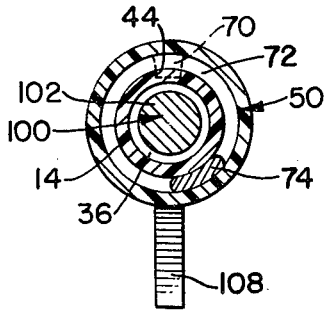
FIG. 4 is a view taken along line 4—4 of FIG. 3.
Figure 5:
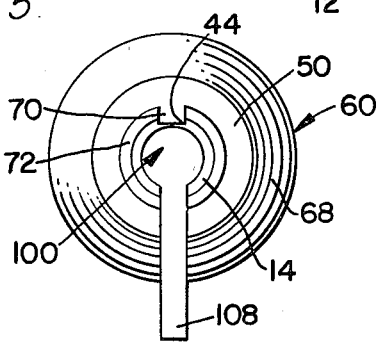
FIG. 5 is an end view of an electrical connector embodying the teachings of the present invention.

As best shown in FIG. 3, insulation I of the cable C is stripped at one end thereof to expose the electrical connecting strand S of that cable as indicated at E in FIG. 3.

The connector 10 includes a sheath 14 which surrounds the stripped end of the cable and is securely held in place on that cable by jam nut 16. The jam nut includes a cylindrical body 18 having external threads 20 thereon and a cap 22 which has a lower surface 24 which abuts rim 26 of proximal end 28 of the sheath 14. The jam nut includes a bore 30 which receives the cable C therethrough. The proximal end 28 has internal threads 32 defined on inner surface 34 of longitudinal bore 36 thereof to cooperatively receive the threads 20 of the jam nut. Alternatively, internal threads 32 can be omitted and the threads 20 can act as self-tapping threads. The body of the jam nut and the threads 20 and 32 are sized so that as the jam nut is threadedly engaged with the sheath, that jam nut tightly and frictionally fixes the cable to the sheath.

As shown in FIG. 3, the sheath 14 extends beyond the cable and has a distal end 40 spaced from the cable stripped end. An elongate notch 44 is defined in the sheath distal end and extends longitudinally of that sheath. The purpose of the notch 44 will be discussed below.

A sleeve 50 surrounds the sheath 14 and as shown in FIGS. 1 and 3, includes an anterior end 52 located inwardly adjacent the sheath distal end and a posterior end 54 located inwardly adjacent the sheath proximal end.

The sleeve is unitary and includes a boss 60 integrally formed on the posterior end thereof and a mandible portion 62 of the gripping jaw 12 integrally mounted on the anterior end thereof. The boss includes a rearwardly declining frusto-conical portion 66 and a fillet-like portion 68. The boss serves as a hand rest, as will be evident from the ensuing disclosure. A lip 70 is defined on the anterior end of the sleeve to be directed inwardly of bore 72 which is defined longitudinally of the sleeve. The lip is located on the sleeve to be diametrically opposite the mandible portion 62, and a lip 74 is located adjacent the jaw mandible portion 62. Alternatively, the lip 74 can be circumambient the sleeve with the lip 70 depending therefrom.

The bore 72 is larger in diameter than the outer diameter of the sheath 14 so an annular space 78 is defined between the sheath and the sleeve. A coil spring 82 surrounds the sheath and is located within the space 78. A projection 86 is defined on the sheath and forms a spring stop against which one end of the spring 82 is seated. The other end of the spring is seated against the lips 70 and 74. Set screws 90 are located in the boss 60 to be between the projection 86 and the sheath proximal end and abuts the projection 86 to prevent the sleeve from separating from the sheath.

A maxilla portion 100 of the gripping jaw 12 is formed by a cylindrical body 102 having a blind-ended bore 104 in one end thereof which receives the strand S of the cable. A set screw 106 securely attaches the body 102 to the cable strand S. The body is thus electrically connected to the cable. A radially extending portion 108 is located to cooperate with the jaw mandible portion 62 to grasp the terminal T therebetween. Serrations 112 improve the grip of the jaw 12 on the terminal.

The spring 82 biases the movable mandible portion toward the fixed maxilla portion of the jaw so that in the normal condition, the jaw portions tend toward a closed configuration. Because of the closing bias exerted on the sleeve by the spring, the abutment means, comprised of the set screws 90 and projection 86, is required to prevent this bias from separating the sleeve and the sheath.

The sleeve and the sheath, as well as the jaw mandible portion 62, are all formed of electrically insulative material so that the only electrical path formed by the connector 10 consists of jaw maxilla portion 100 and the cable C. Other paths may promote short circuits, and may be dangerous. Movement of the jaw mandible portion is telescopic with relation to the sheath and is guided by the lip 70 and the notch 44 so the jaw portions remain properly oriented with respect to each other as the mandible is forced backwards to open the jaw so a terminal T can be received in the open jaw 12. The boss on the sleeve acts as a hand rest so that the sleeve is easily gripped to effect this movement of the sleeve. Upon release of the jaw opening force, the sleeve 50 moves, under the influence of the spring 82, toward the jaw portion 108 to grip the terminal T in the jaw 12.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A connector for connecting an electrical cable to a terminal comprising:

a non-conductive sheath attached at a first end thereof to an electrical cable to surround that cable and extend at another end thereof beyond the end of that cable, said first sheath end having screw threads defined therein, an elongate slot defined therein at said another end, and a projection located near said sheath first end;

a jam nut connecting said first end of said non-conductive sheath to said cable, said jam nut including a bore which receives said cable and external threads which cooperate with said sheath threads;

an electrically conductive jaw portion electrically and fixedly connected to the electrical cable, said jaw portion having a body located within said non-conductive sheath;

a non-conductive sleeve telescopingly mounted on said sheath, said sleeve including a lip on one end and a boss on another end, said lip being located within said sheath slot, said sleeve and said sheath being spaced apart to define an annulus;

a non-conductive jaw movable portion on said sleeve and in facing opposition to said electrically conductive jaw portion;

yieldable spring means located in said annulus and having one end seated against said sheath projection and another end seated against said sleeve lip to connect said sleeve to said sheath, said sleeve being movable with respect to the cable mounted sheath whereby a terminal is grasped between said jaw portions to electrically connect that terminal to the cable via said conductive jaw portion; and a set screw in said sleeve boss, said set screw abutting said sheath projection on a side of that projection opposite to the side therof on which is seated said spring one end, said set screw preventing said sleeve from separating from said sheath.

2. The connector defined in claim 1 further including serrations on said jaw portions.

3. The connector defined in claim 1 wherein said lip and slot align said jaws with respect to each other.

* * * * *